US010172395B2

(12) United States Patent
Scutte et al.

(10) Patent No.: US 10,172,395 B2
(45) Date of Patent: Jan. 8, 2019

(54) ARTICLE OF CLOTHING FOR CARRYING A CONCEALED WEAPON

(71) Applicant: CAN CAN CONCEALMENT LLC, Odessa, FL (US)

(72) Inventors: Alison Scutte, Oldsmar, FL (US); Darlene Cahill, New Port Richey, FL (US)

(73) Assignee: CAN CAN CONCEALMENT LLC, Odessa, FL (US)

( * ) Notice: Subject to any disclaimer, the term of this patent is extended or adjusted under 35 U.S.C. 154(b) by 0 days.

(21) Appl. No.: 14/051,537

(22) Filed: Oct. 11, 2013

(65) Prior Publication Data

US 2015/0102078 A1 Apr. 16, 2015

(51) Int. Cl.

| | |
|---|---|
| ***F41C 33/00*** | (2006.01) |
| ***F41C 33/02*** | (2006.01) |
| ***A41C 1/00*** | (2006.01) |
| ***F41C 33/04*** | (2006.01) |
| *A45F 5/00* | (2006.01) |

(52) U.S. Cl.

CPC ..... *A41C 1/00* (2013.01); *F41C 33/048* (2013.01); *A45F 2005/008* (2013.01); *A45F 2200/0591* (2013.01)

(58) Field of Classification Search

CPC ..... F41C 33/048; A45F 2200/0591; A45F 2005/008

USPC ..... 224/587, 183, 267

See application file for complete search history.

(56) References Cited

U.S. PATENT DOCUMENTS

| | | | | |
|---|---|---|---|---|
| 1,418,371 | A * | 6/1922 | Foster | 224/182 |
| 3,008,617 | A * | 11/1961 | Villwock | 224/183 |
| 4,446,574 | A * | 5/1984 | Kalomeris | 2/338 |
| 4,579,265 | A * | 4/1986 | Schiller | 224/682 |
| 5,141,141 | A * | 8/1992 | Leone | 224/587 |
| 5,431,318 | A * | 7/1995 | Garcia | 224/192 |
| 5,642,847 | A * | 7/1997 | DeMeo et al. | 224/623 |
| 5,894,976 | A * | 4/1999 | Harper | 224/587 |
| 5,909,834 | A * | 6/1999 | Parrott, III | 224/587 |
| 6,006,363 | A * | 12/1999 | Karlin | 2/228 |
| 6,131,198 | A * | 10/2000 | Westrick | 2/102 |
| 6,264,079 | B1 * | 7/2001 | Skaggs | 224/193 |
| 6,814,270 | B2 * | 11/2004 | Mason | 224/587 |
| D642,792 | S * | 8/2011 | Tremblay | D3/218 |
| D657,951 | S * | 4/2012 | Davis et al. | D3/222 |
| D694,518 | S * | 12/2013 | Aissa et al. | D3/224 |
| 8,727,294 | B1 * | 5/2014 | Harms | 248/346.01 |
| 8,733,606 | B2 * | 5/2014 | Felts | 224/671 |
| D710,089 | S * | 8/2014 | Lively | D3/222 |
| 8,943,616 | B2 * | 2/2015 | Carter-Cohen | 2/300 |
| 2003/0197042 | A1 * | 10/2003 | Warren | 224/183 |
| 2005/0223466 | A1 * | 10/2005 | Jennings et al. | 2/102 |
| 2006/0196907 | A1 * | 9/2006 | Pruitt | 224/587 |
| 2007/0250980 | A1 * | 11/2007 | Pellerin | 2/69 |
| 2008/0272162 | A1 * | 11/2008 | Gamble | 224/243 |
| 2010/0108728 | A1 * | 5/2010 | Castaneda | 224/243 |

(Continued)

FOREIGN PATENT DOCUMENTS

FR 2939609 A1 * 6/2010 ..... A41F 9/00

*Primary Examiner* — Justin Larson

(57) ABSTRACT

An article for carrying a concealed weapon having a main body forming an undergarment, at least one holster body incorporated with said main body, said holster body defining a holster cavity, and at least one magnet positioned inside or adjacent to said holster cavity.

1 Claim, 5 Drawing Sheets

(56) References Cited

U.S. PATENT DOCUMENTS

| | | | | |
|---|---|---|---|---|
| 2010/0176174 | A1* | 7/2010 | Felts | 224/666 |
| 2011/0220698 | A1* | 9/2011 | Tuggle | 224/587 |
| 2011/0226825 | A1* | 9/2011 | Sanford | 224/243 |
| 2012/0234886 | A1* | 9/2012 | Barbier | 224/587 |
| 2012/0248162 | A1* | 10/2012 | Ornelas et al. | 224/267 |
| 2012/0255979 | A1* | 10/2012 | Sitz | 224/243 |
| 2013/0219581 | A1* | 8/2013 | Schrimpf | 2/69 |
| 2013/0254976 | A1* | 10/2013 | Aravena | 2/300 |
| 2014/0054347 | A1* | 2/2014 | Warren | 224/587 |
| 2014/0158734 | A1* | 6/2014 | Bickert et al. | 224/587 |
| 2014/0263499 | A1* | 9/2014 | Carter-Cohen | 224/267 |

* cited by examiner

ARTICLE OF CLOTHING FOR CARRYING A CONCEALED WEAPON

BACKGROUND OF THE INVENTION

The carrying of a concealed weapon typically imparts concerns related to carrying the weapon in a safe manner. For some, particularly women, this present additional difficulties. Most women clothing is not particularly accommodating for the safe carrying of a concealed weapon.

The present invention addresses this difficulty by providing an article incorporating undergarments configured with structures to safely carry a weapon.

SUMMARY OF THE INVENTION

In incorporating concealed weapon carrying articles into an undergarment, the present invention contemplates providing a more safe and aesthetically pleasing means in which women can carry their concealed weapons.

In one embodiment, the present invention is, an article for carrying a concealed weapon comprising:

a main body forming an undergarment;

at least one holster body incorporated with said main body, said holster body defining a holster cavity; and at least one magnet positioned inside or adjacent to said holster cavity.

When the undergarment is attached to the body, the tension of attachment imparts tension on the holster body in the direction towards the wearer. Although tension is imparted, the utilization of magnets provides an additional level of a mechanism through which the weapon is held and secured into a safe carrying position.

The present invention is contemplated as being incorporated into various types of undergarments. In one embodiment, the main body forms of undergarment constructed and arranged to wrap around a wearer's inferior torso. This essentially can be referred to as an undergarment wraps around the hip region similar to the area where a conventional waist belt will be worn In one embodiment, the main body forms of undergarment constructed and arranged to wrap around the thigh of a wearer. In this configuration, this will be similar to the position where a garter would be worn about the thigh of a user.

In one embodiment, the main body forms of undergarment constructed and arranged to wrap around a majority of a wearer's inferior half torso region. In this embodiment, the torso is generally understood to divide in substantially equal halves whereby this garment will cover a majority of the lower half of the torso.

In one embodiment, the main body forms of undergarment constructed and arranged as a corset. A corset, as generally understood wraps around substantially most of the torso. Although the embodiment shown in the figure includes armholes, the present invention additionally contemplates a corset configuration that wraps around the torso and does not include armholes.

As generally understood, the holster body is configured to hold and secure a particular weapon. By way of nonlimiting example, the holster body can be configured more narrow to hold a knife, or configured to hold a particular type of gun or taser.

In one embodiment, the article has a plurality of holster bodies incorporated thereon. Plurality, generally understood as at least two holster bodies are formed thereon.

The holster bodies are selectively configured such that in an embodiment where there are multiple holster bodies they can be configured of the same size and shape, or differing sizes and shapes as desired.

The magnet selected imparts sufficient magnetic field to attract and hold a weapon in a fixed position. As generally understood, the magnet should not be so strong so as to prohibitively inhibit removal of the weapon from the holster cavity. However the magnet should be strong enough such that there is magnetic attraction present between the weapon and the magnet.

In one embodiment, the magnet is placed within the holster cavity. In another embodiment, the magnet is configured to be placed in its own separate magnet holding cavity.

Also contemplated in the present invention is a method for carrying a concealed weapon, said method comprising the steps of:

providing an article of the present invention;

attaching said article to a user's body;

selecting at least one weapon; and inserting the weapon into the holster cavity.

The method includes the holster body for a particular weapon. The method further includes a weapon corresponding to the configuration of the holster cavity.

As generally understood, the article and method of the present invention include selecting and carrying at least one weapon from a gun, knife, taser, debilitating spray, baton or combinations thereof.

DETAILED DESCRIPTION OF THE PREFERRED EMBODIMENT

As generally understood, the present invention provides for one or more holding structures incorporated onto and undergarment whereby the holding structure is constructed and arranged to securely hold and carry a concealed weapon.

Figure 3:
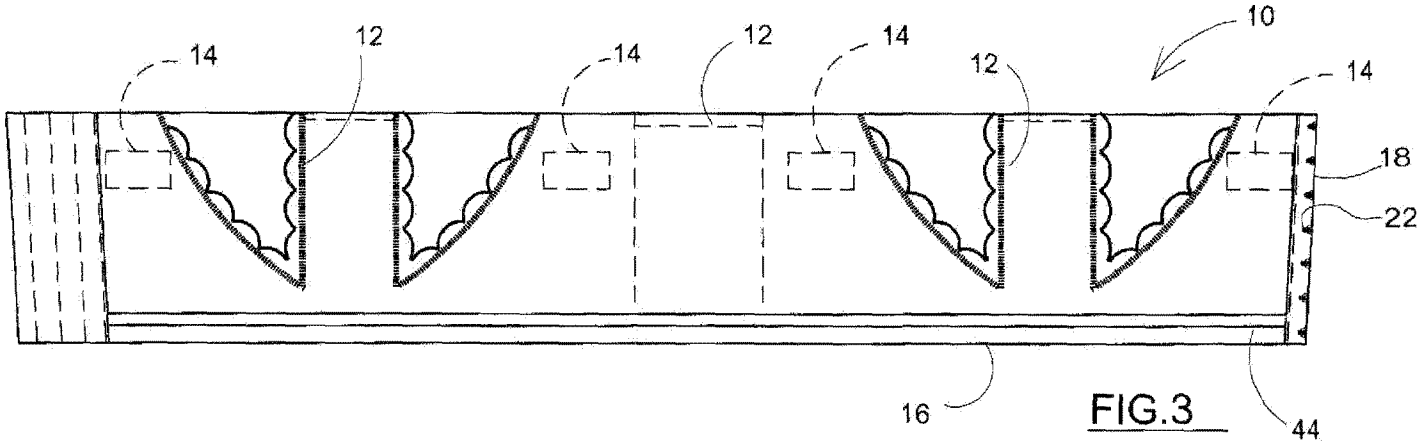
FIG. 3 is a plan view of the proximal side of the article the present invention.
Figure 2:
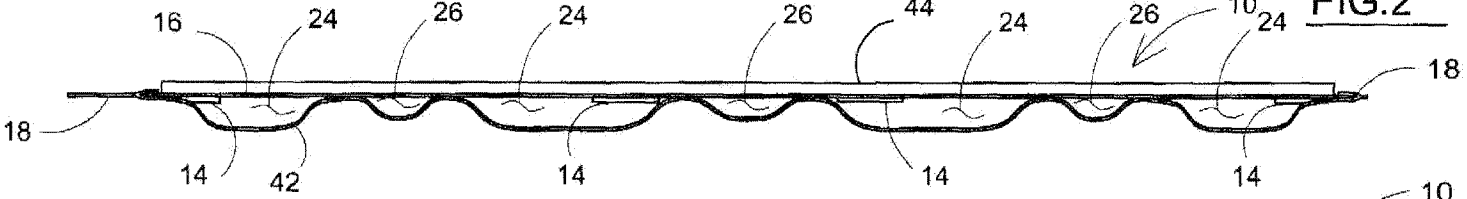
FIG. 2 is a top view of the article of the present invention.
Figure 1:
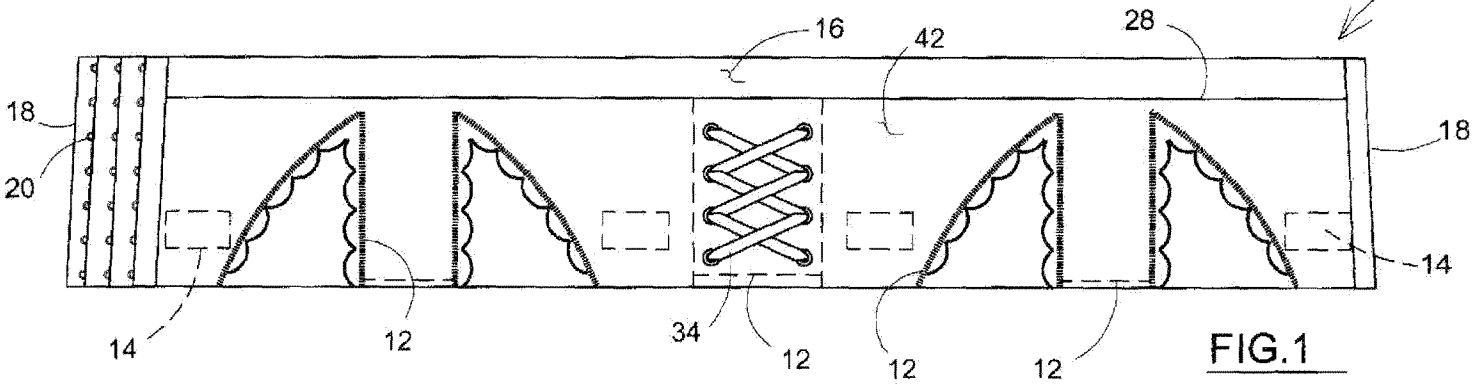
FIG. 1 is a plan view of the distal side of the article of the present invention.

As demonstrated in FIGS. 1-3, article 10 includes a fabric body 18 whereby stitching 12 secures holster body 42 whereby holster body 42 defines holster cavity 24. In a preferred embodiment, one or more magnet cavities 26 are stitched adjacent to holster cavity 24 whereby magnet cavity 26 is constructed and arranged to hold at least one magnet 14 therein. As generally understood, a magnet 14 can be positioned with in holster cavity 42, in magnet cavity 26 or commendations thereof. Cloth body 18 further has incorporated there with at least one edge 16 and opposing fasteners being a first fastener 20 and second fastener 22. In one embodiment, first fastener 20 is a female fastener and second fastener 22 is a male fastener. However, it is contemplated that any acceptable mechanism for fastening the article to the waist of a user is utilized. FIG. 1 represents a plan view that will be distal to the waist of a wearer whereby decorative lacing 34 will be positioned along the back of a user and the article will wrap forward around the torso to the front of a user.

In one embodiment, an edging material 16 is incorporated onto the garment. One embodiment provides edging as elastic, silicone, rubber, polymers, plastics, combinations thereof, and the like in order to provide additional mechanism for securing the garment into position and avoid movement or slippage. The edging contacts and establishes friction to the skin in order to limit and/or prevent unwanted movement.

Figure 4:
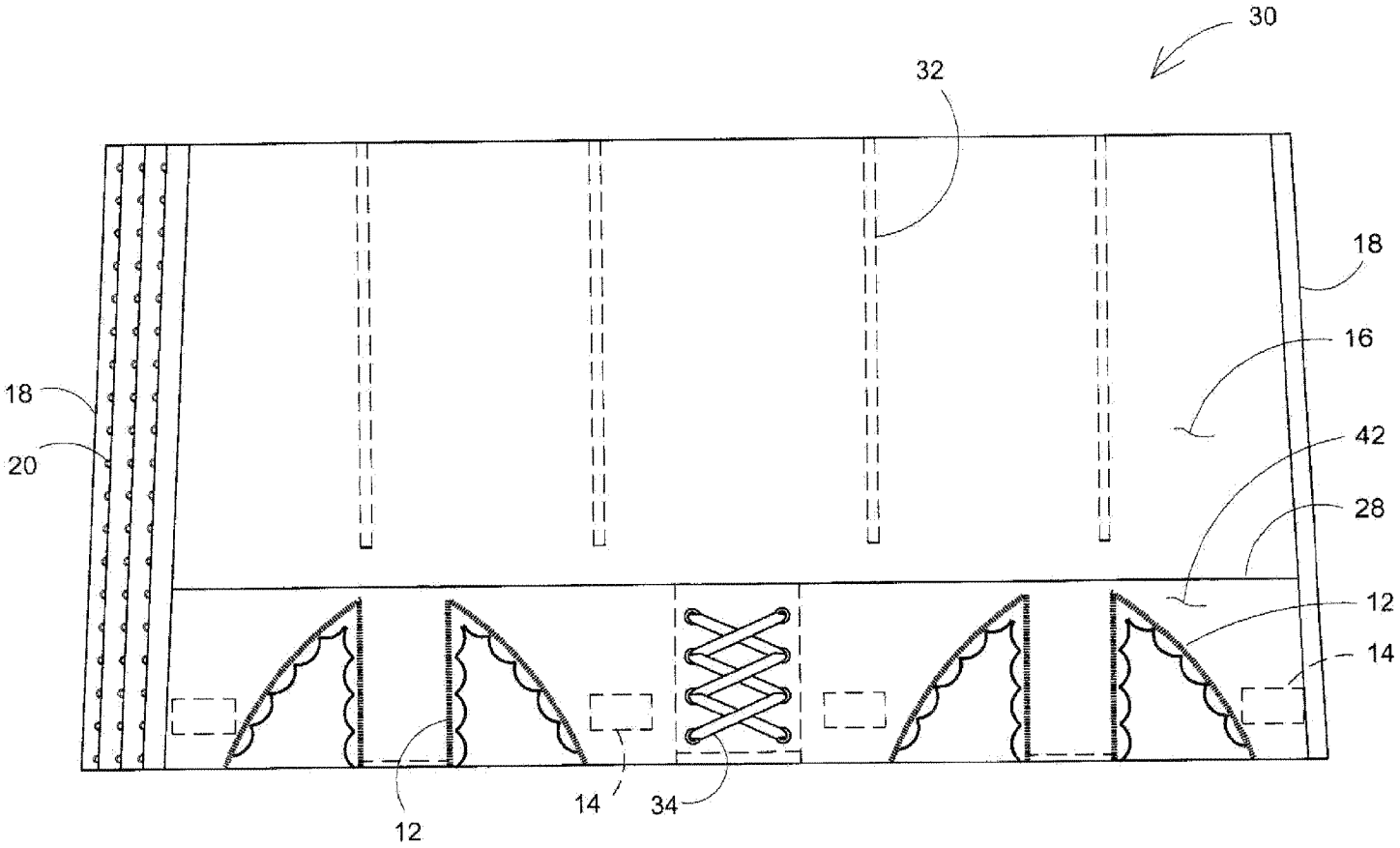
FIG. 4 is a plan view of an embodiment of the article of the present invention incorporated with a waist wraparound structure.
Figure 5:
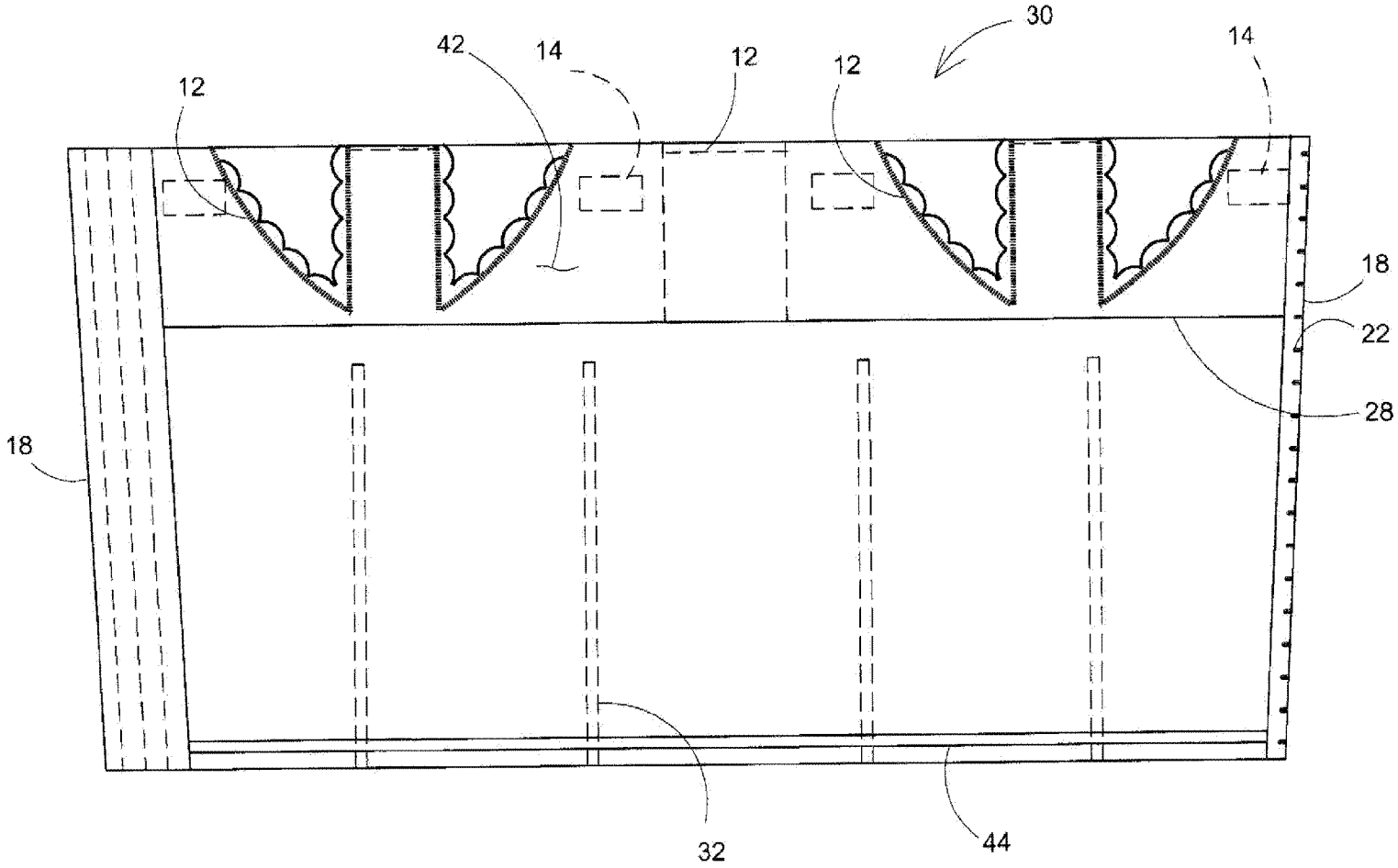
FIG. 5 is a plan view of the proximal side of an embodiment of the present invention incorporated with a waist wraparound structure.

In the embodiment demonstrated in FIGS. 4 and 5, one embodiment of the present invention incorporates the holster into a torso wrap around configuration 30 having the same functional components described above.

Figure 7:
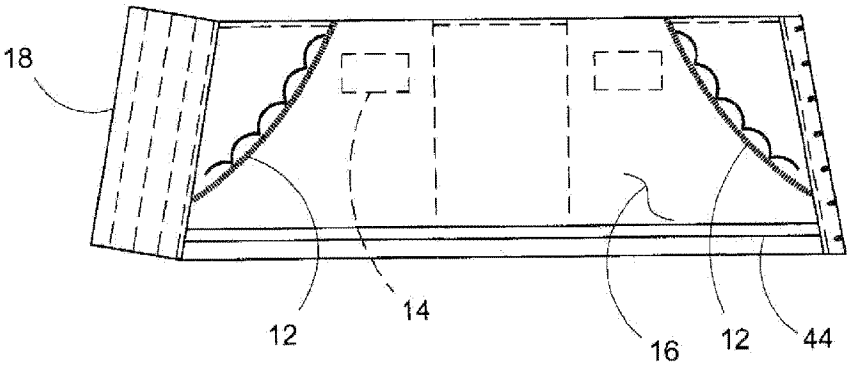
FIG. 7 is a plan view of the proximal side of an embodiment of the present invention configured to wrap around like a user.
Figure 6:
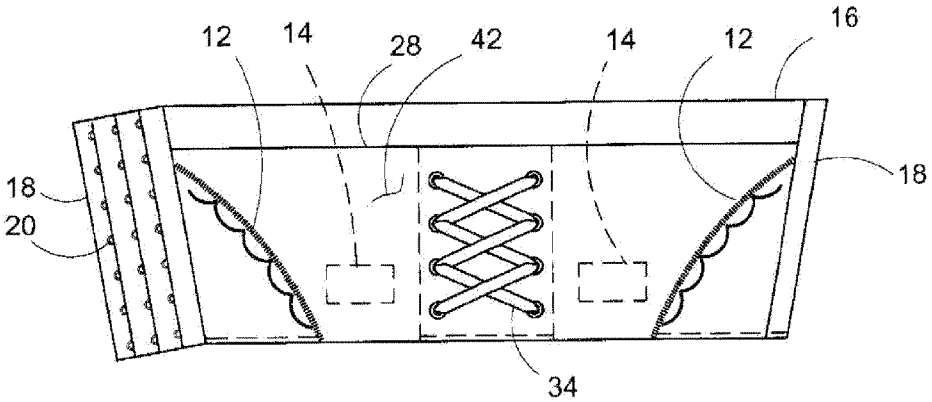
FIG. 6 is a plan view of the distal side of an embodiment of the present invention configured to wrap around the leg of a user.

The present invention further contemplates a configuration such as FIGS. 6 and 7 whereby the holster of the present invention is configured into a size and shape suitable to wrap around the thigh of a user.

Figure 8:
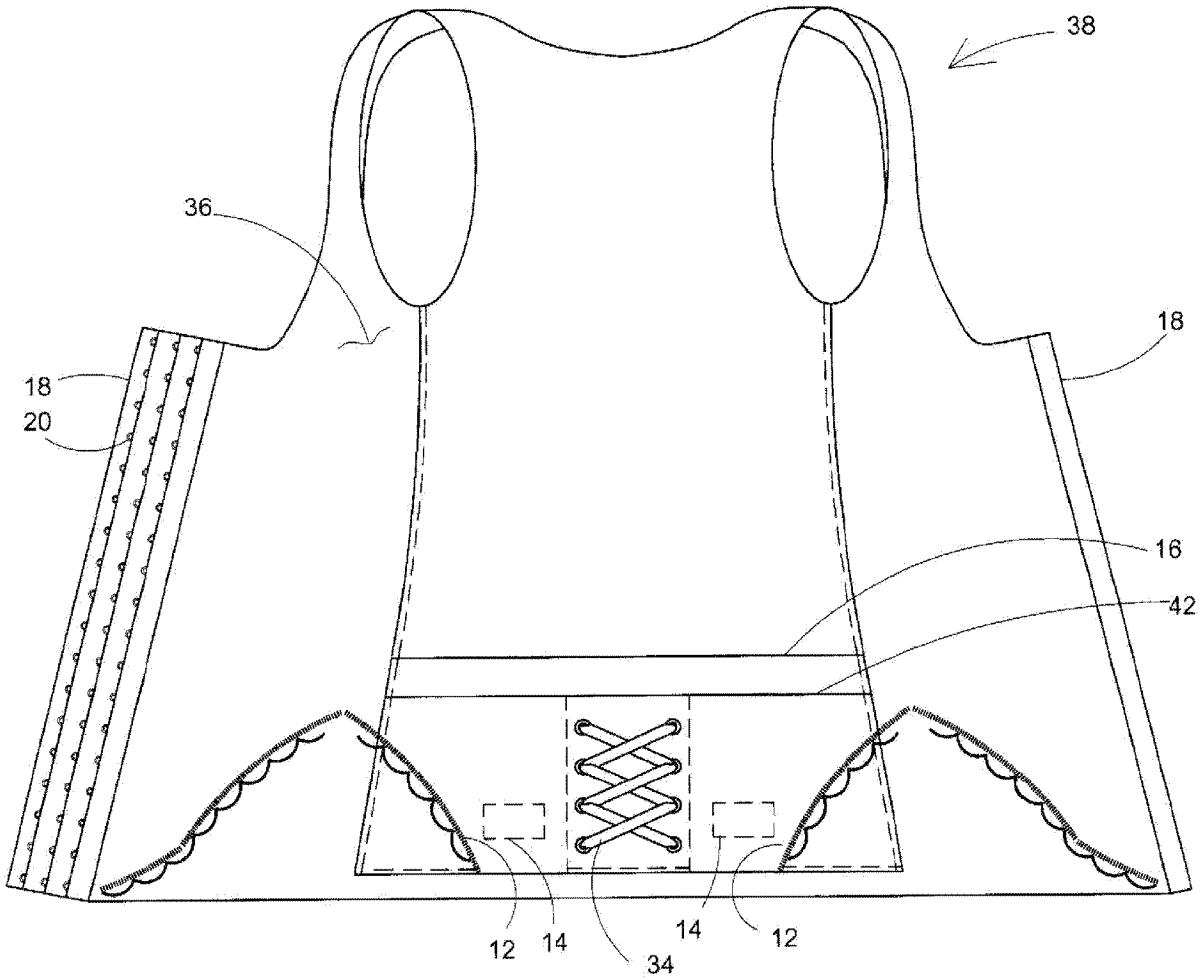
FIG. 8 is a plan view of an embodiment of the present invention incorporated into a corset structure.

The embodiment of FIG. 8 is configured into a corset type structure 38 having armholes and a corset body 36 configured such that a user will insert an arm in each armhole and wrap the structure around their torso for wearing.

In use, and article will be provided whereby at least one holster cavity 42 is incorporated thereon. A user will access the cavity from a superior direction relative to their body. The cavity will typically be partially closed on the inferior edge to prevent a weapon from passing completely through the cavity.

The present invention represents an improvement over prior holster configurations in that the configuration is incorporated into an existing undergarment. Further improvement provides that the weapon be held securely in the position that not only by tension imparted by holster body 42 around a weapon but additionally by magnetic force imparted by magnet 14 positioned adjacent to a weapon placed with in holster body 42.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. An article for carrying a concealed gun comprising:

a main body formed of an interior strip and an exterior strip, the main body forming an undergarment with a top and a bottom and arranged to wrap around a portion of a wearer;

plural lines of stitching including curved and straight lines of stitching extending upwardly from the bottom toward the top to form holsters incorporated between the interior and exterior strips;

the plural lines of stitching also including straight lines of stitching extending upwardly from the bottom toward the top and at least one horizontal line of stitching adjacent to the bottom to form at least one pocket incorporated within said main body; and at least one magnet positioned inside of each holster, wherein said magnet imparts sufficient magnetic field to attract and hold the gun in a fixed position within the holster.

* * * * *